US005531602A

United States Patent [19]

Harper, Jr. et al.

[11] Patent Number: 5,531,602

[45] Date of Patent: Jul. 2, 1996

[54] ADAPTER ASSEMBLY FOR A SMALL OUTLINE PACKAGE

[75] Inventors: Donald K. Harper, Jr., Harrisburg; Michael F. Laub, Etters; James P. Pacelli, Lancaster; William J. Schnoor, Hummelstown, all of Pa.

[73] Assignee: The Whitaker Corporation, Wilmington, Del.

[21] Appl. No.: 315,368

[22] Filed: Sep. 30, 1994

[51] Int. Cl.[6] ..... H01R 23/68

[52] U.S. Cl. ..... 439/70; 439/912

[58] Field of Search ..... 439/525, 526, 439/70, 71, 72, 73, 74, 67, 77, 493, 492, 499, 912

[56] References Cited

U.S. PATENT DOCUMENTS

| | | | |
|---|---|---|---|
| 4,190,311 | 2/1980 | Basta | 439/331 |
| 4,460,236 | 7/1984 | Strautz | 339/176 M |
| 4,671,592 | 6/1987 | Ignasiak et al. | 439/331 |
| 4,696,525 | 9/1987 | Coller et al. | 439/69 |
| 4,718,855 | 1/1988 | Billman et al. | 439/70 |
| 4,768,972 | 9/1988 | Ignasiak et al. | 439/330 |
| 4,816,751 | 3/1989 | Seiichi et al. | 324/73 PC |
| 4,872,844 | 10/1989 | Grebe et al. | 439/69 |
| 5,208,529 | 5/1993 | Tsurishima et al. | 324/158 F |
| 5,306,167 | 4/1994 | Nagumo | 439/226 |

*Primary Examiner*—Neil Abrams
*Assistant Examiner*—T. C. Patel
*Attorney, Agent, or Firm*—June B. Schuette

[57] ABSTRACT

An adapter assembly (20) for electrical connection between a small outline integrated circuit (SOIC) (25) and a remote receptacle connector (87) via a cable including a plurality of electrical conductors (23) comprises a nonconductive adapter housing (21) providing a plurality of spaced-apart slots (39) for receiving a plurality of contacts (22). The SOIC (25) being received in a cavity (50) at the bottom of the adapter housing (21), is retained within the cavity (50) by retention teeth (57) engaging respective side retention areas (54) located between each two adjacent leads (24) of the SOIC (25), and by a pair of retention members (55) engaging respective end retention areas (56) of the SOIC (25). A removable clip (26) is locked over the adapter housing (21). Each contact (22) being received in the respective slot (39), engages a respective lead (24) of the SOIC (25) by its lower portion (61). An upper portion (62) of each contact (22) terminates the respective electrical conductor (23).

14 Claims, 10 Drawing Sheets

ADAPTER ASSEMBLY FOR A SMALL OUTLINE PACKAGE

FIELD OF THE INVENTION

The present invention relates to connectors for electronic packages, and more particularly, to adapters for small outline packages.

BACKGROUND OF THE INVENTION

Integrated circuit (IC) packages appear in leadless and leaded configurations. Leaded integrated circuit (IC) packages can be formed in various configurations. For example an IC package identified as an "FN plastic chip carrier package", manufactured by Texas Instruments, is described in U.S. Pat. No. 4,768,972. Such IC packages are of generally square shape in top plan of view and may have from 20 to 68 terminals or leads arranged in four equal groups respectively along or proximate to each side of the IC package. Another type of IC package, disclosed in U.S. Pat. No. RE 28,064, is an IC of dual-in-line (DIP) package type. The DIP comprises an IC which is totally encapsulated within a dielectric body, and a plurality of spaced-apart leads arranged in two parallel rows of the leads on the two parallel sidewalls of the dielectric body.

Connectors of various configurations are used to make electrical connections with each of the leads of IC packages for signal testing, signal analyzing and/or for signal transmission into the IC during the normal operating of the IC package. These connectors are disclosed, for example, in U.S. Pat. Nos. 4,460,236; 4,671,592; 4,768,972; etc. All described connectors include non-conductive body provided with a holding mechanism for retaining the connector in the proper operative position with respect to the IC package. The non-conductive body carries a plurality of contacts in spaced-apart positions for electrically connecting with respective leads of the IC package.

For example, a clip connector disclosed in U.S. Pat. Nos. 4,671,592; 4,768,972 (assigned to Minnesota Mining and Manufacturing Company) makes electrical connections with each of the leads of a plastic chip carrier package (PLCC) of generally square shape. The leads are located at all sides of the PLCC. The described test clip includes a non-conductive generally rectangular body and a plurality of electrical contacts at each side of the rectangular body. Each side of the rectangular body includes a plurality of wall-like separators for separating the electrical contacts supported by the respective side. Retaining means for holding the clip connector to the PLCC includes latching arms at respective corners of the rectangular body and a slide actuator therefor which is operative to deflect the latching arms and the contacts for engaging and disengaging the latching arms with respect to the PLCC body corners, and the contacts with respect to the PLCC leads, respectively. This clip connector is not applicable for DIPs.

A low-profile test clip adapter for DIPs is disclosed in U.S. Pat. No. 4,190,311 and is shown herein in FIGS. 1 and 2. According to this latter patent, the clip (10) for electrical connecting to ICs packaged in a DIP, including a body (11) having spaced-apart electrical contacts (12) rigidly mounted within the body (11) and arranged in two parallel rows; a cable (13) comprising a plurality of insulated electrical conductors for carrying electrical signals from a test instrument to the IC package to be tested, and a pair of arms (14) pivotally mounted on said body (11). Said electrical contacts (12) each includes inwardly-directed, arcuate-shaped terminal-contact sections (15) for providing electrical connection with the terminals (or leads) of the IC package and conductor-connecting sections (16) for making electrical contact with said electrical conductors of the cable (13). Each of the pair of said arms (14) comprises finger-like projections (17) for gripping the IC package between each pair of adjacent terminals (or leads) thereon. Top portion of each said arm (14) includes a respective slot (18) for passing said cable (13) therethrough. Said arms (14) are secured to said body (11) via an O-ring or other elastic member (19).

Disadvantageously, the above described clip adapter is somewhat complicated and difficult in assembling and requires additional means for securing all elements of the adapter to each other in their precise predetermined registration while they have been aligned. Misalignment of the elements of the clips can cause a reliability and quality assurance problems. The contacts cannot be removed from the body and replaced once a damage of contact occurs. Moreover, the electrical conductors passing through both sides of the clip adapter, burdens the design and may make the clip adapter to be unapplicable for high component density PCBs.

SUMMARY OF THE INVENTION

It is, therefore, an object of the present invention to provide an adapter assembly for small outline IC package allowing a reliable electrical contact (through respective contacts) between leads of the IC package and respective electrical conductors of the cable.

The present invention, may find its particular utility as an adapter assembly removably secured to a dual-in-line type small-outline integrated circuit package.

According to the teachings of the present invention, the adapter assembly includes an adapter housing having a pair of spaced-apart walls integrally connected by main body portion and raised above the main body portion. The main body portion carries a plurality of contacts, with lower portions received in slots of the main body portion. Each contact is electrically connected by its respective lower portion to a respective lead on the sides of the IC body.

One of the walls of the adapter housing includes an opening for receiving respective electrical conductors, each electrical conductor in electrical connection with the upper portion of the respective contact.

In its bottom part, the adapter housing includes a cavity for receiving the IC body. A retention means are disposed within said cavity for a frictional interference with the respective retention areas of the IC body.

A removable clip embraces the walls of the adapter housing and is locked thereon by respective tabs which fit into respective recesses of the walls of the adapter housing.

A spacer is removably inserted between the clip and the upper portions of the contacts.

These and other objects of the present invention will become apparent from a reading of the following specification taken in conjunction with the enclosed drawings.

DETAILED DESCRIPTION OF THE INVENTION

Figure 1:
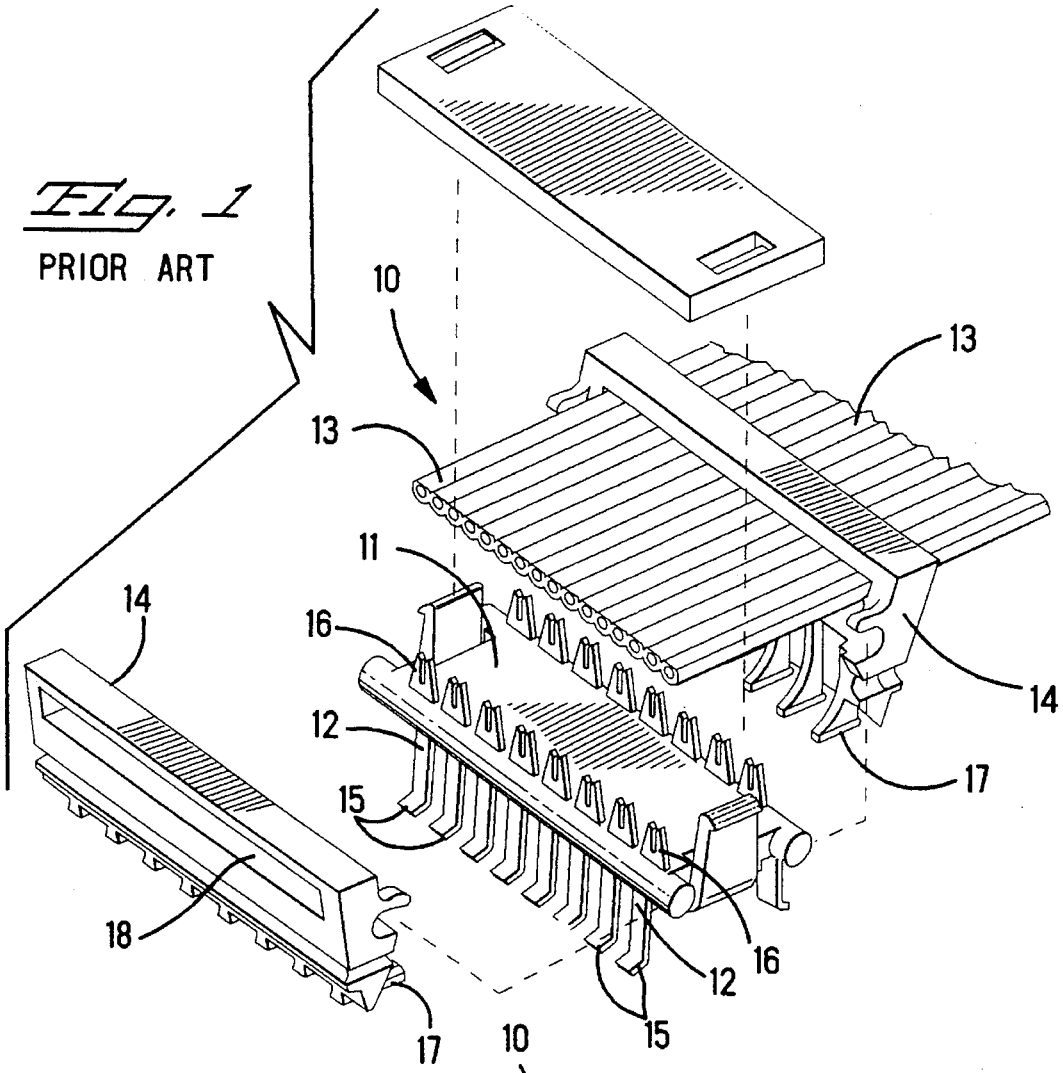
Fig. 1 PRIOR ART
FIG. 1 is a perspective exploded view of a clip adapter of the prior art.
Figure 2:
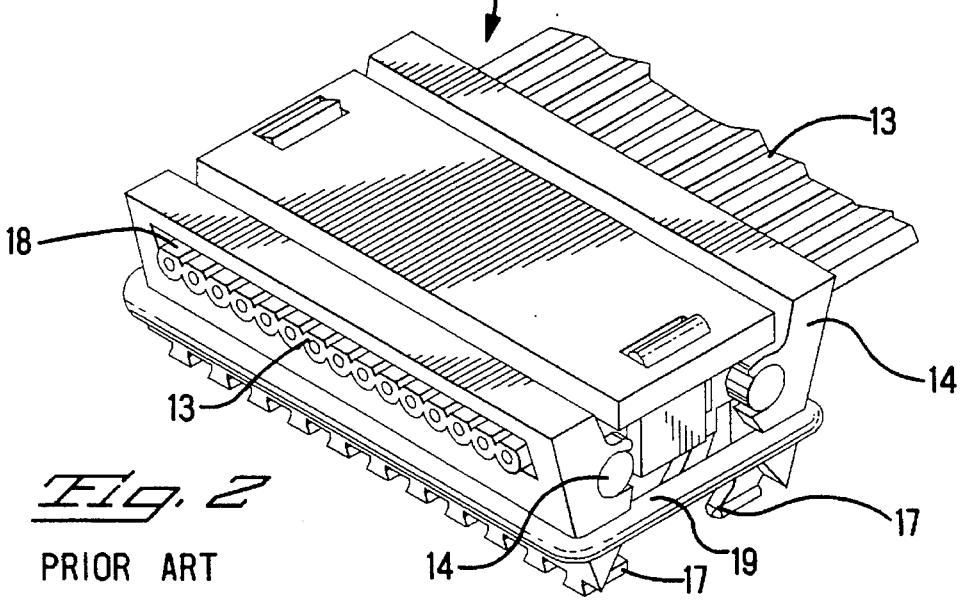
Fig. 2 PRIOR ART
FIG. 2 is a perspective view of the assembled clip adapter of the prior art.
Figure 3:
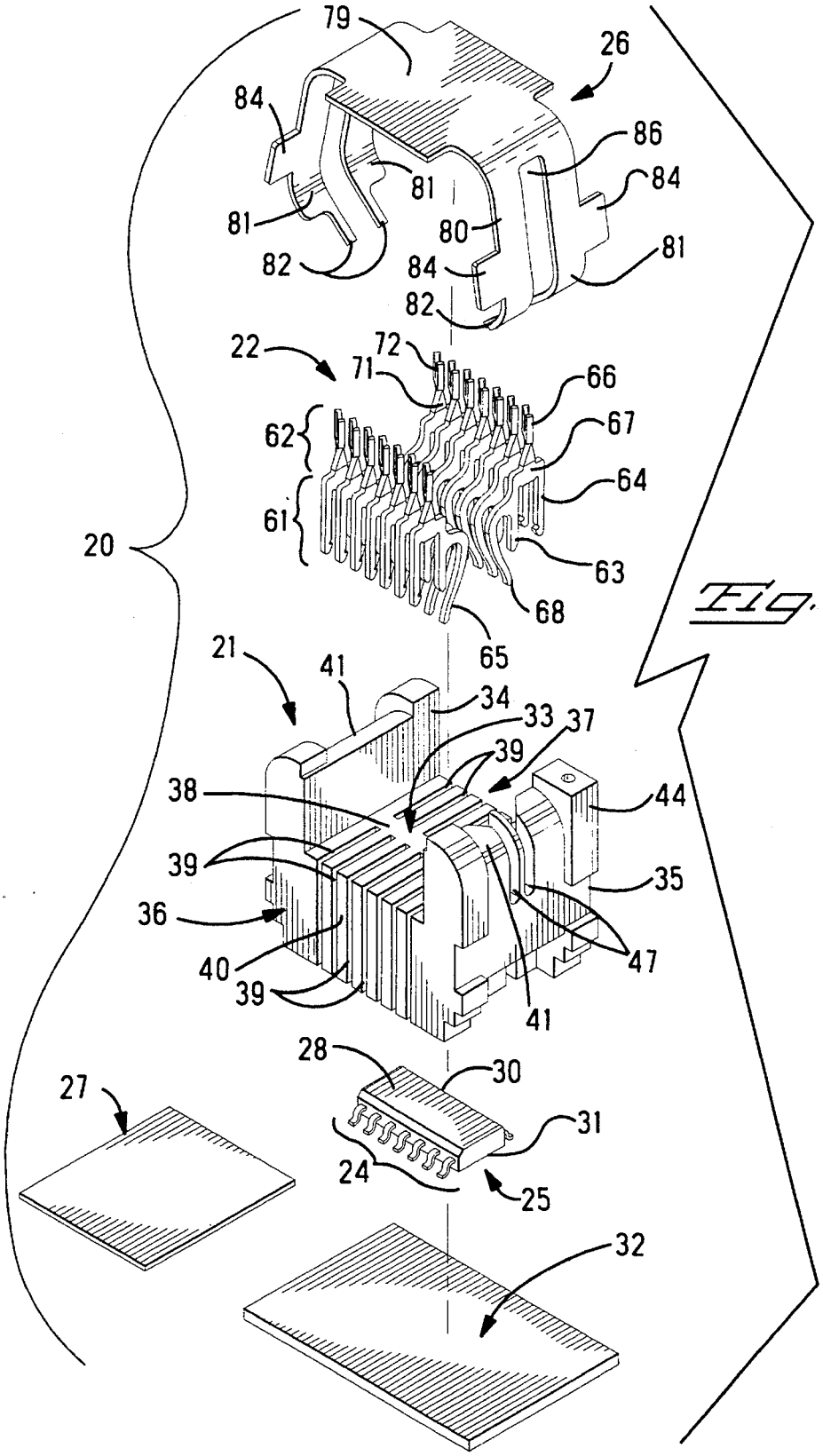
FIG. 3 is a perspective exploded view of the adapter assembly of the present invention.
Figure 4:
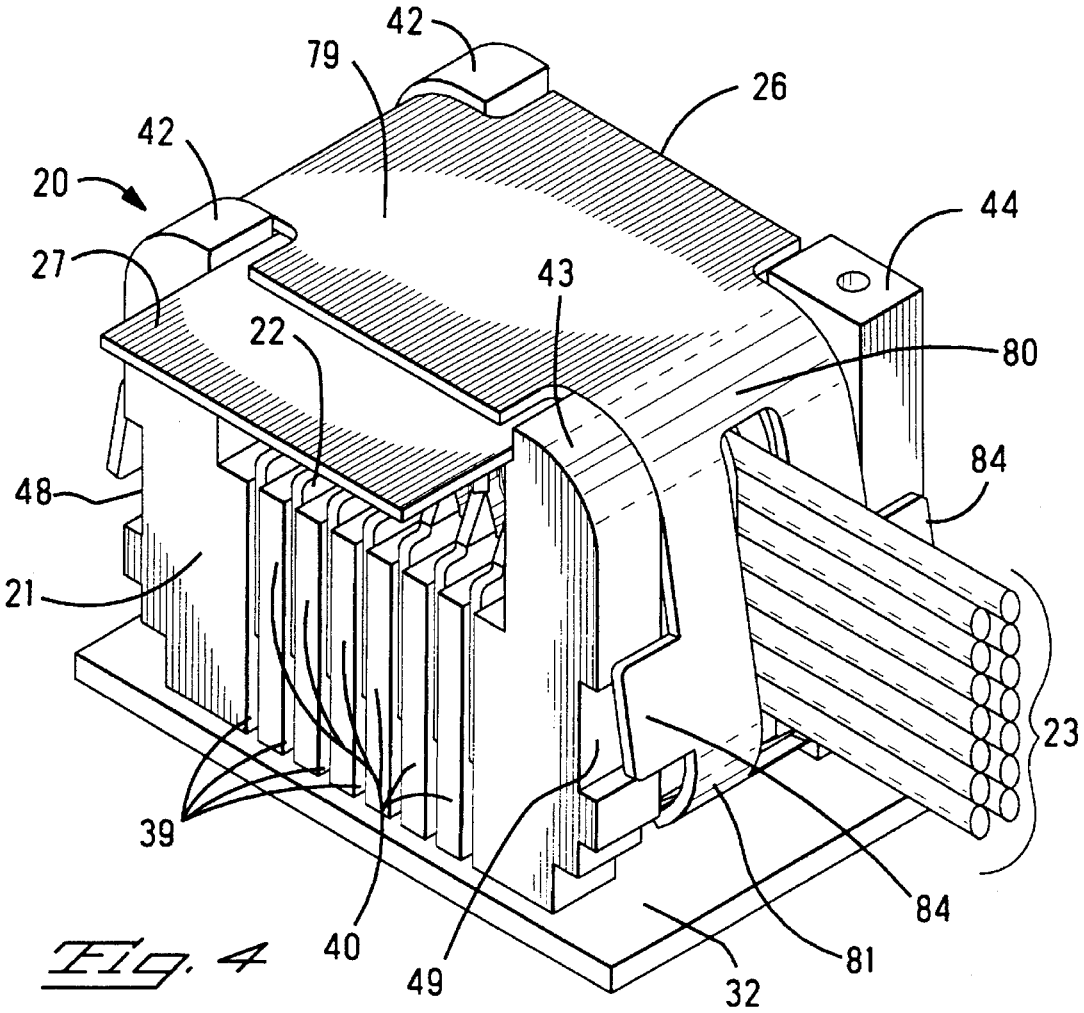
FIG. 4 is a perspective view of an adapter assembly of the present invention.

Referring to FIGS. 3–16, an adapter assembly 20 includes a non-conductive adapter housing 21 carrying a plurality of contacts 22 for electrical connection between electrical conductors 23 and respective leads 24 located on IC package 25. The electrical conductors 23 connect the adapter assembly 20 to a remote receptacle connector. A clip 26, serving for improved retention, is locked over the adapter housing 21 (once contacts 22 are installed into the adapter housing 21 and the electrical conductors 23 are terminated in the contacts 22). A spacer 27 is removably disposed beneath the clip to prevent premature clip 26 actuation.

The IC package 25 is an integrated circuit of a small outline package type (SOIC). It includes a dielectric IC body 28 (with IC encapsulated within the IC body 28) and a total from 14 to 64 spaced-apart leads 24 arranged in two parallel rows of two parallel sidewalls 29 of the IC body 28. The leads 24 are partially enclosed within the IC body 28 and partially are extended outwardly from the IC body 28. The leads 24 are bent outwardly to form feet parallel to the top and bottom surfaces 30, 31 of the IC body 28 respectively, and parallel to a PCB 32 to which they are mounted. SOICs are mounted on the PCB 32 in predetermined locations by soldering the leads 24 to respective pads (not shown) on the PCB's 32 surface.

The adapter housing 21, molded of electrically and thermally non-conductive material, includes a main body portion 33 and two spaced-apart walls 34, 35. The walls 34, 35 are integrally connected to the main body portion 33 and are raised above the main body portion 33. The main body portion 33 has longitudinal sides 36, 37 which include spaced-apart substantially identical and substantially parallel slots 39, and separated by a central longitudinal element 38. The slots 39 are parallel to the walls 34, 35. Each two adjacent slots 39 are separated by a respective separating wall 40. If the main body portion 33 carries fourteen contacts 22 (seven contacts 22 on the longitudinal side 36, and seven contacts 22 on the longitudinal side 37), total seven slots 39 and six separating walls 40 would be needed on each longitudinal side 36, 37. It will be appreciated by those skilled in the art, that the number of slots 39 and the number of separating walls 40 will vary according to number of leads 24 of the IC package 25 to which the adapter assembly 20 is to be connected.

The walls 34, 35 are curved in their upper edges to form an arched upper edge 41. Three arched corner members 42, 43 and a single square corner member 44, which serves as an identification mark, are located at corners of the adapter housing 21. Two arched corner members 42 are located on the external surface of the wall 34; the arched corner member 43 and the square corner member 44 are located on the external surface of the wall 35, such that they are raised above the respective arched upper edge 41 and simultaneously they are raised above the respective external surface of the respective walls 34,35. One of the arched corner member 42 located at the wall 34 is shorter in its upper arched portion than another arched corner member 42, thereby leaving a supporting ledge 45 on the internal surface of the wall 34. The arched corner member 43 also provides a supporting ledge 46 on the internal surface of the wall 35. The supporting ledges 45, 46 serve for supporting the spacer 27 which is used to prevent a premature clip 26 actuation. The arched upper edge 41 of the wall 35 provides two slots 47 for pass through of the electrical conductors 23. The number of electrical conductors 23 passing through each slot 47 corresponds to the number of contacts 22 received in the slots 39 on each longitudinal side 36 of the main body portion 33, and respectively corresponds to the number of the leads 24 located on each sidewall 29 of the IC body 28.

Each wall 34, 35 provides retention recesses 48, 49 on their respective external surfaces. The retention recesses 48, 49 serve for retaining the clip 26 over the adapter housing 21.

Figure 5:
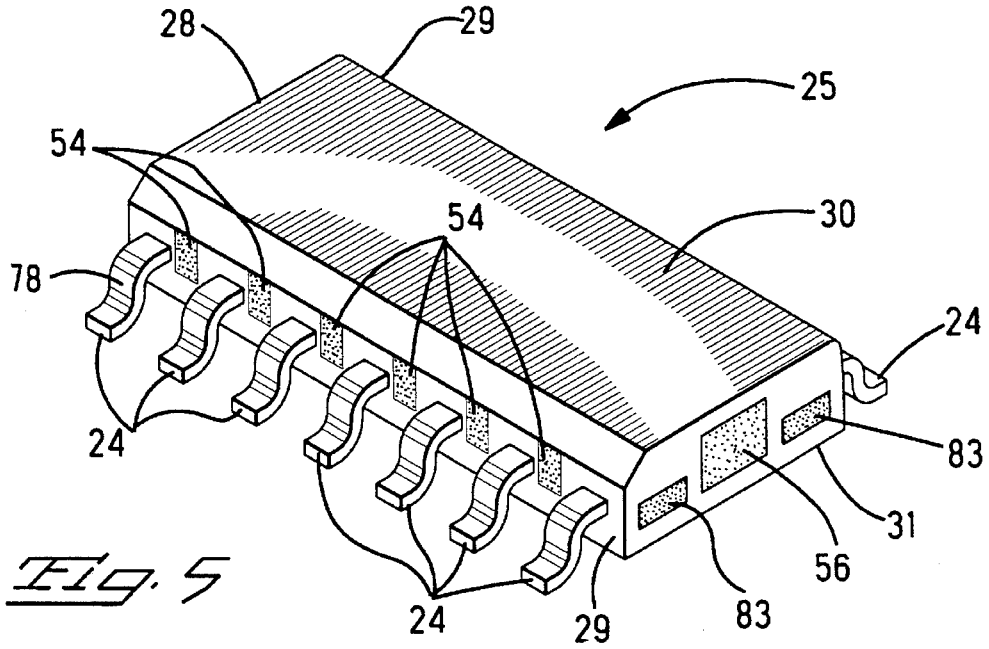
FIG. 5 is an enlarged perspective view of the small outline IC package of a dual-in-line type.
Figure 6:
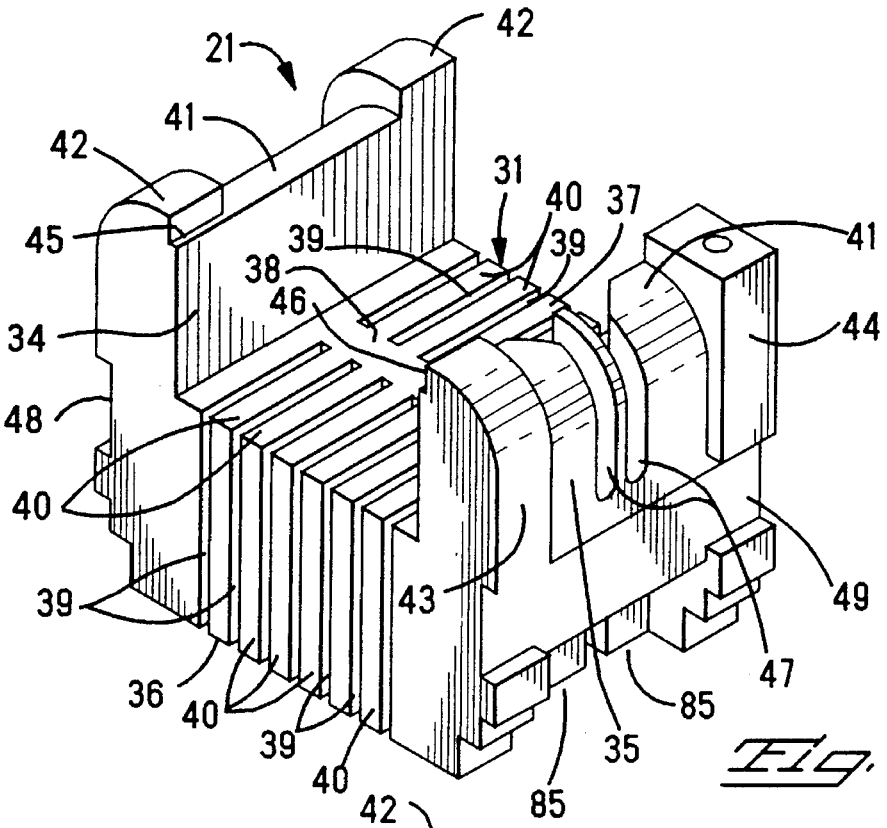
FIG. 6 is an enlarged perspective view of the adapter housing.
Figure 7:
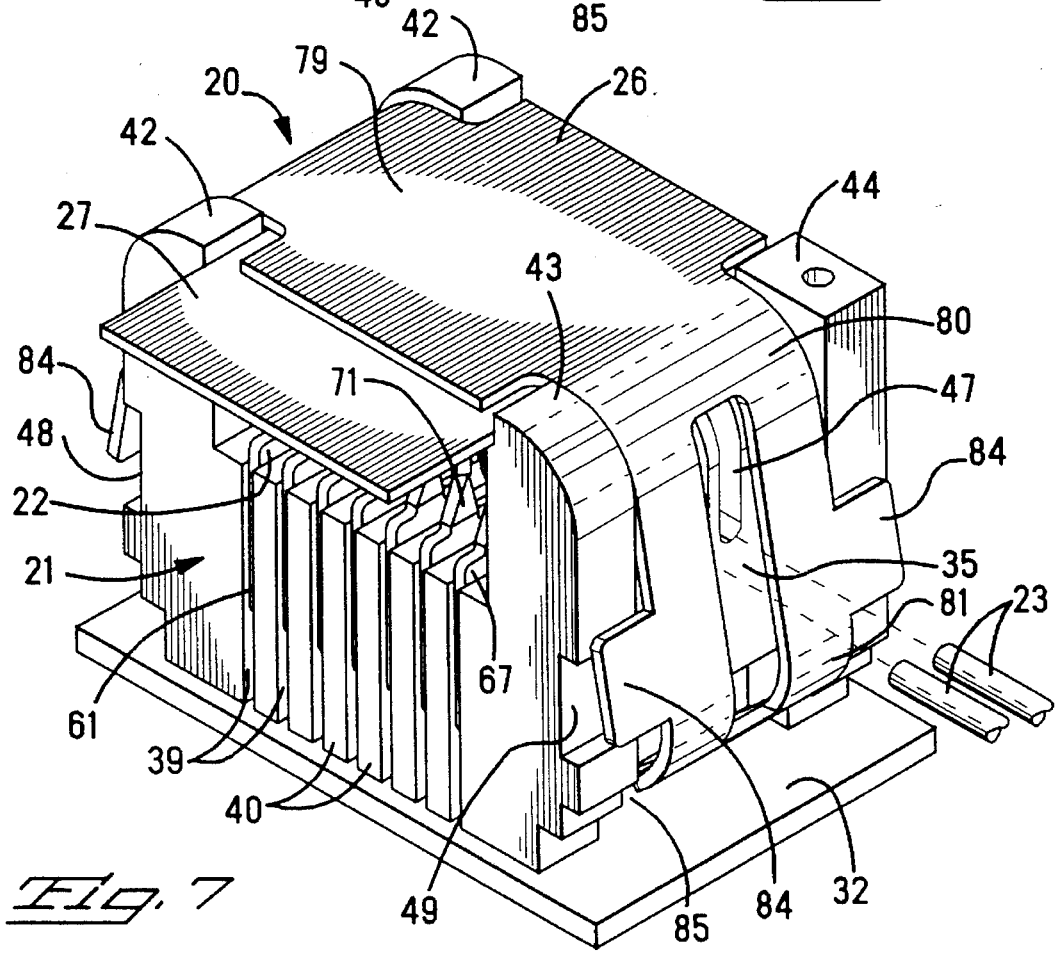
FIG. 7, 8 are enlarged perspective views of the adapter assembly showing clip in opened and in locked positions, respectively.
Figure 8:
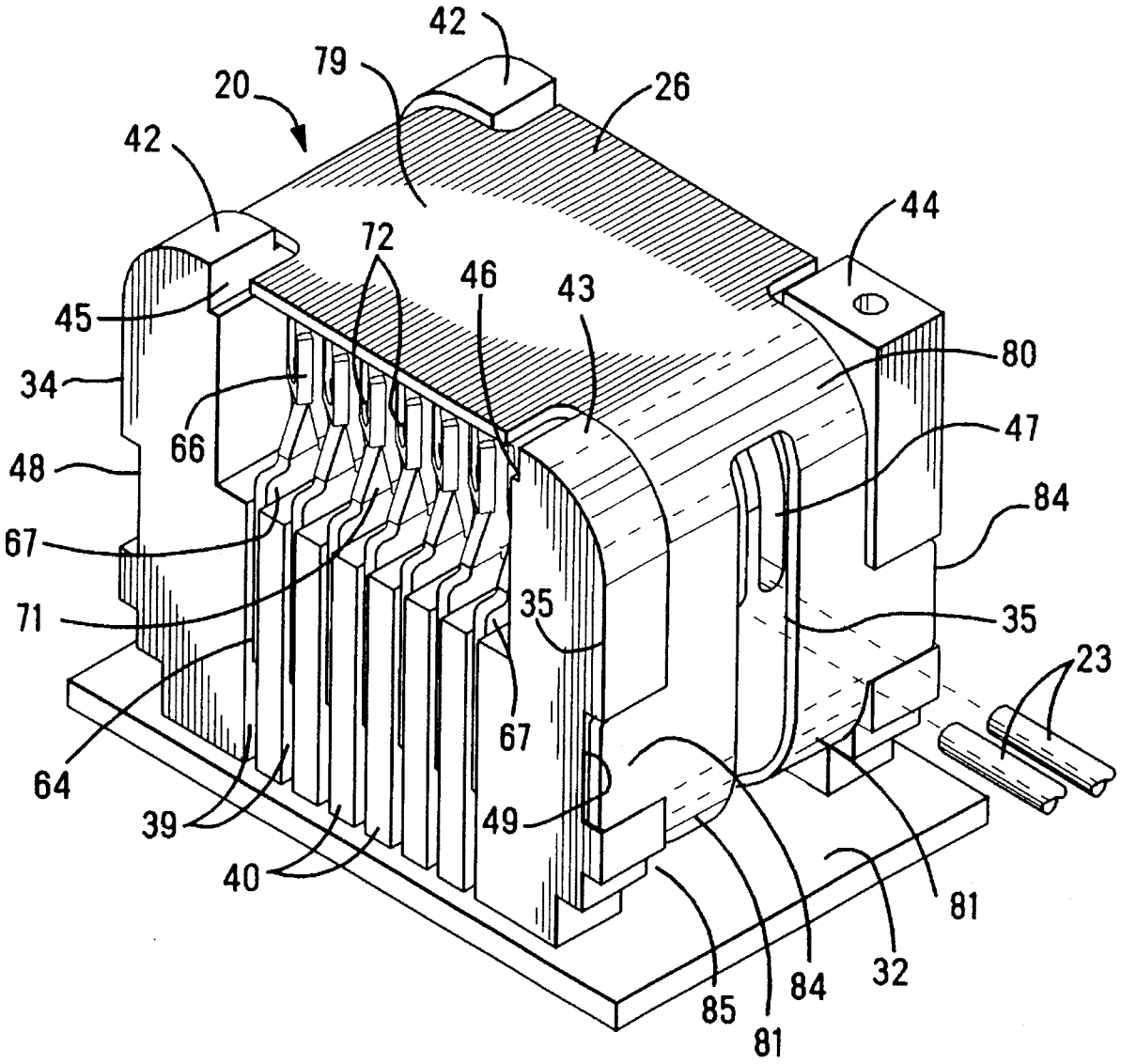
Figure 9:
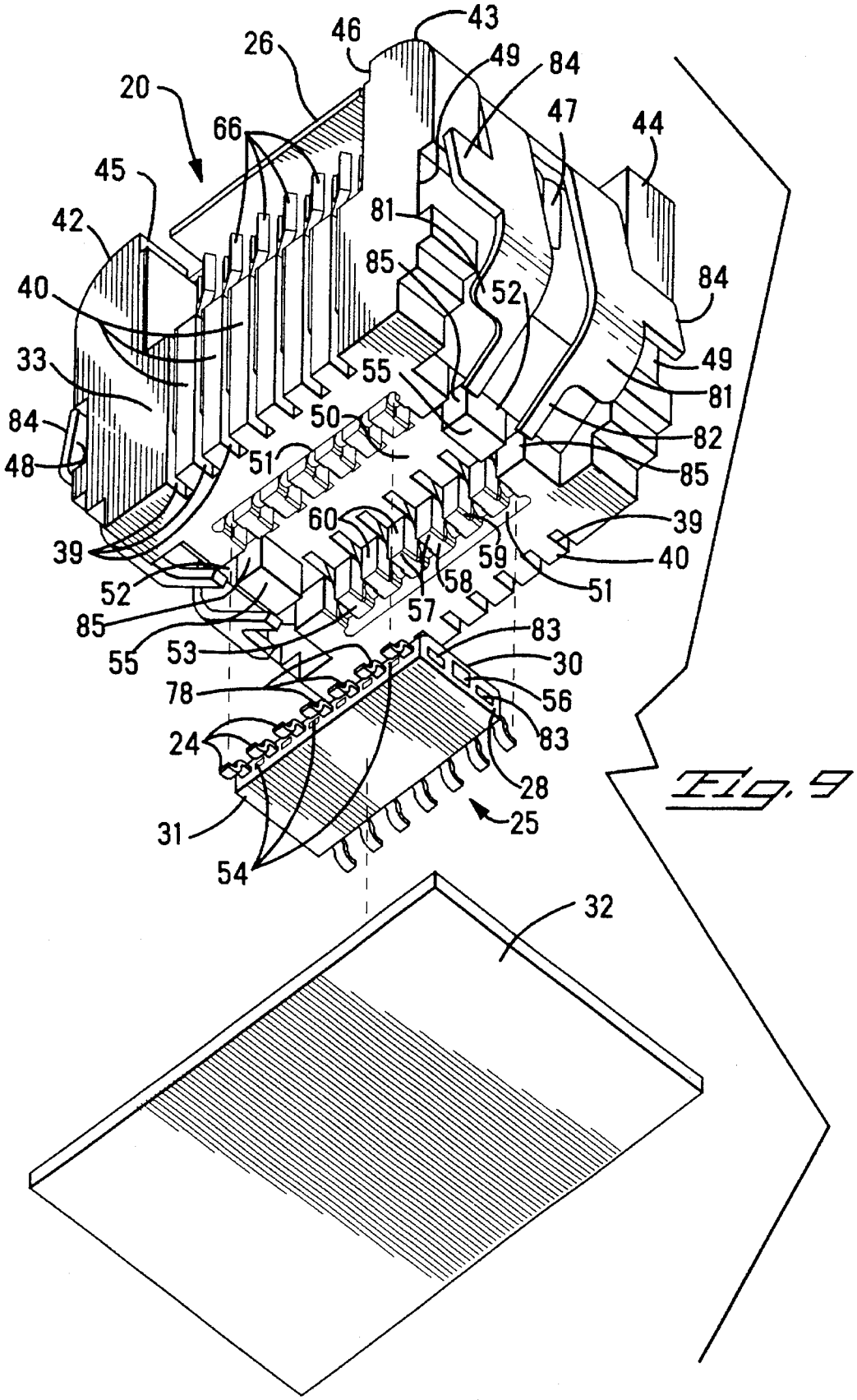
FIG. 9 is a perspective bottom view of the adapter assembly.
Figure 10:
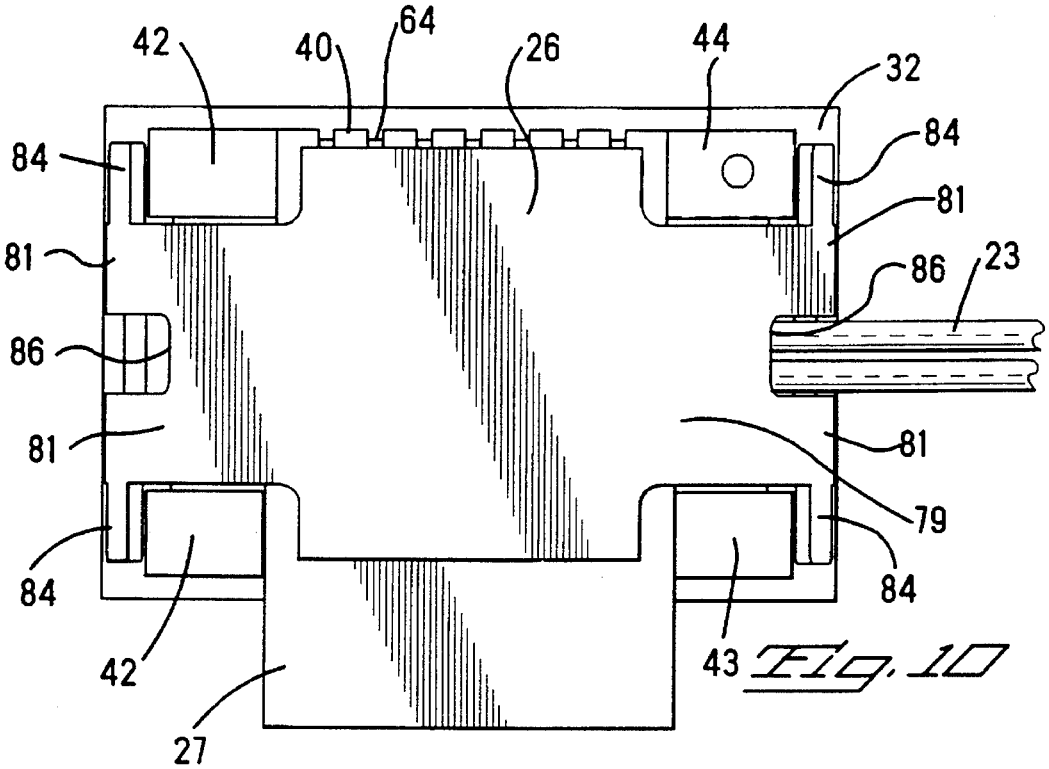
FIG. 10 is an upper view of the adapter assembly.
Figure 11:
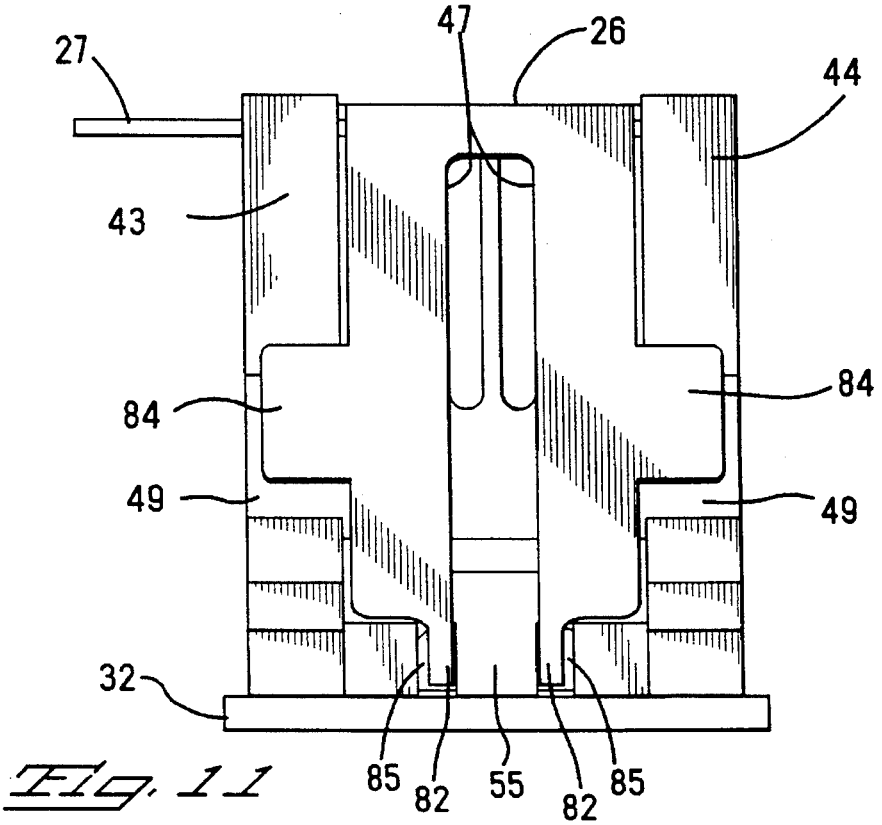
FIG. 11 is a side view of the adapter assembly.

Referring to FIGS. 5 and 9, a cavity 50 for receiving the IC package 25 is provided in the bottom part of the adapter housing 21. The cavity 50 includes sidewalls 51, and ends 52. Spaced-apart retention teeth 53 are integrally molded on the respective sidewalls 51 to engage respective side retention areas 54 of the IC body 28. Each side retention area 54 is located between two adjacent leads 24. Retention members 55 are integrally molded on the respective ends 52 of the cavity 50 to engage respective end retention areas 56 on the IC body 29. The adapter housing 21 is being lowered down on the IC package 25, and, when the IC package 25 is snapped into its place in the cavity 50, the retention teeth 53 and the retention members 55 are biased inwardly and are in frictional interference with the respective retention areas 54 and 56 on the IC body 28 to retain the IC package 25 within the adapter housing 21 in predetermined interposition.

Each retention tooth 53 includes a narrower tooth body 57 and a wider tooth body 58, which form a ledge 59 between them. When contact area 60 of the retention teeth 53 engages the respective side retention area 54 on the IC body 28, the ledge 59 engages bent portions of the leads 24. The wider tooth body 58 engages the contacts 22 for proper alignment of the contacts 22 relative to the leads 24.

Referring to FIGS. 3, 4, 7–9, 12–16, a plurality of copper alloy contacts 22 are carried by the adapter housing 21. Each contact 22 includes a lower and an upper portion 61, 62, respectively. The lower portion 61 includes retention fingers 63, 64 and a contact leg 65. The upper portion 62 includes a bifurcated end 66. Respective joining ends of the retention fingers 63, 64 are integrally joined by a beam 67. The contact leg 65 is integrally joined by its joining end to the retention finger 63 close to its joining end. Another contact end 68 of the contact leg 65, provides a contact point 69 for contact with the respective lead 24. The retention finger 64 has a barbed end 70 which locks the contact 22 in the respective slot 39 in the adapter housing 21. The bifurcated end 66 is integrally joined to the beam 67 by a twisted neck 71. The twisted neck 71 provides a respective angle between the lower portion 61 and the bifurcated end 66, turning an insulation displacement contact area 72 for a conductor 23 termination, towards the respective conductor 23, thereby facilitating in guiding the electrical conductors 23 to their respective contacts. The insulation displacement contact area 72 removes the insulation around the conductor 22, thereby providing an electrical contact between the respective contact 22 and the respective conductor 23.

Figure 12:
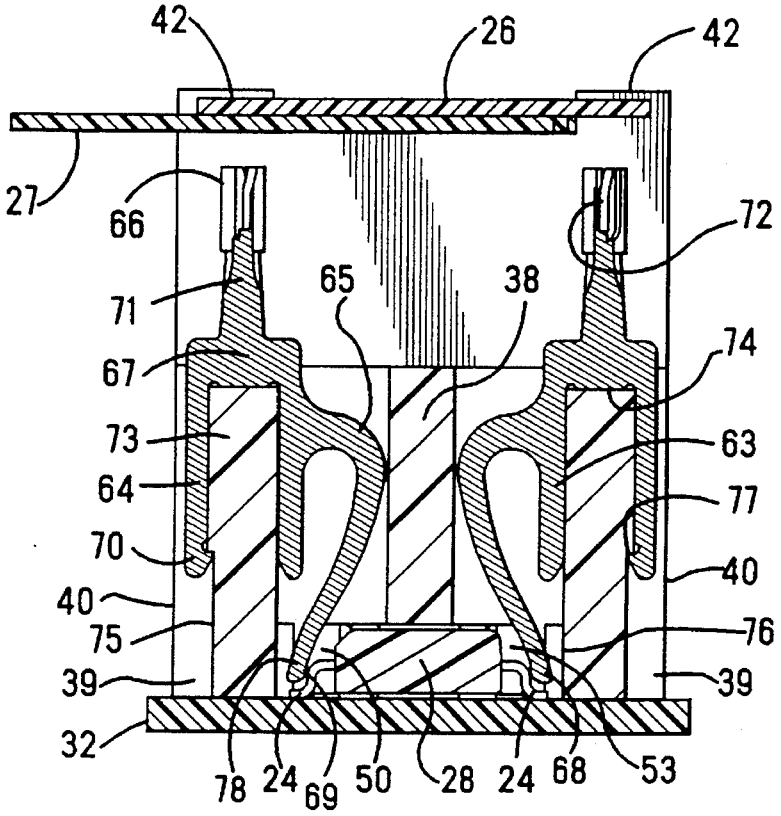
FIG. 12 is a cross-sectional view of FIG. 3 taken along one of the slots with a contact in it.
Figure 13:
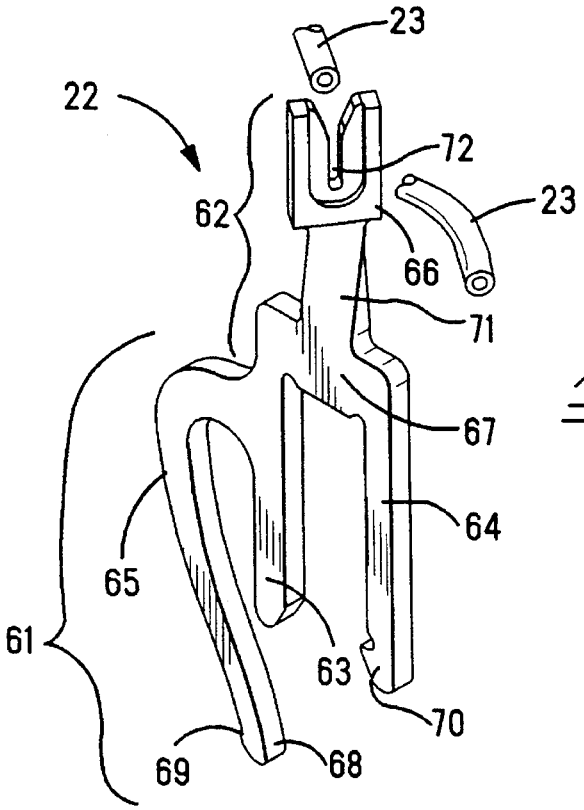
FIG. 13 is an enlarged perspective view of a contact.
Figure 14:
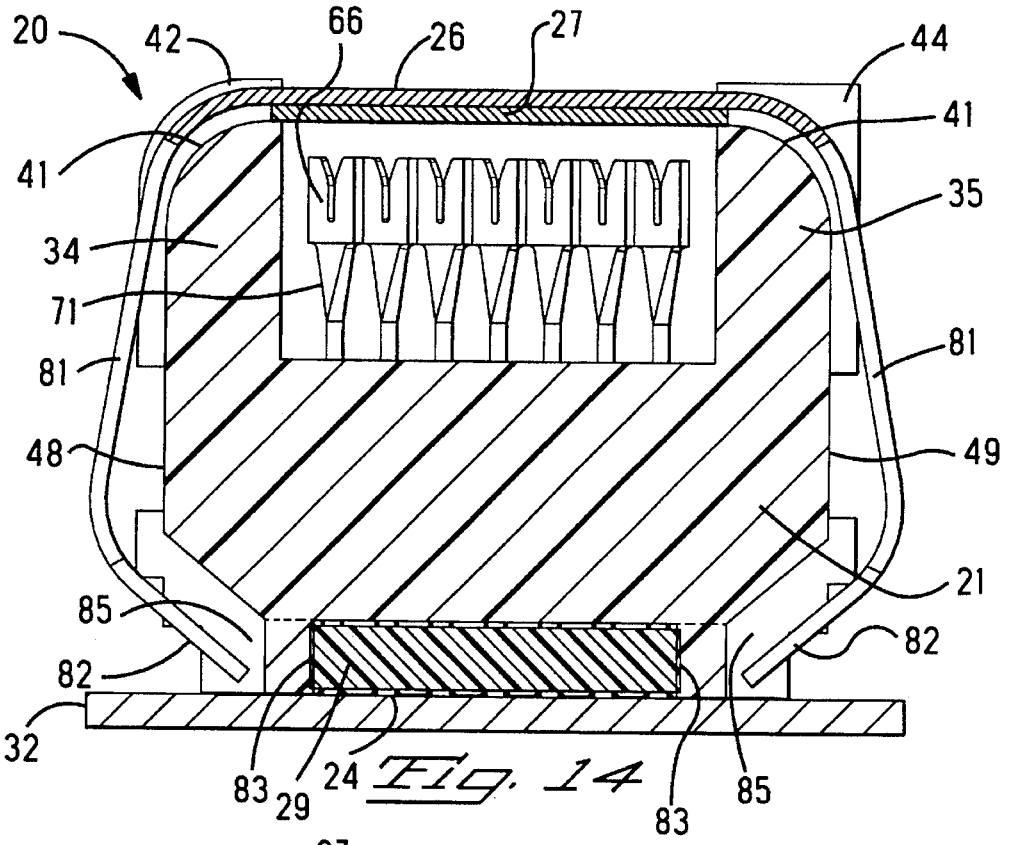
FIGS. 14, 15 are longitudinal-sectional views of the adapter assembly (the clip is opened, wires do not terminate in the contacts).
Figure 15:
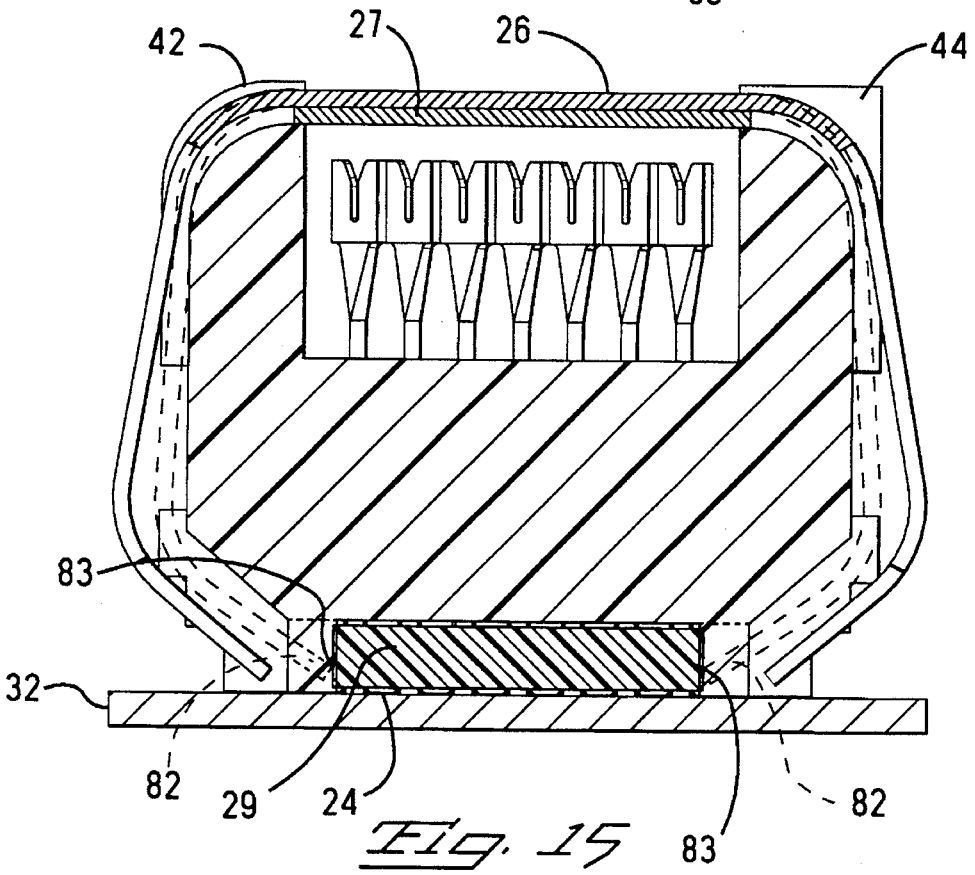
Figure 16:
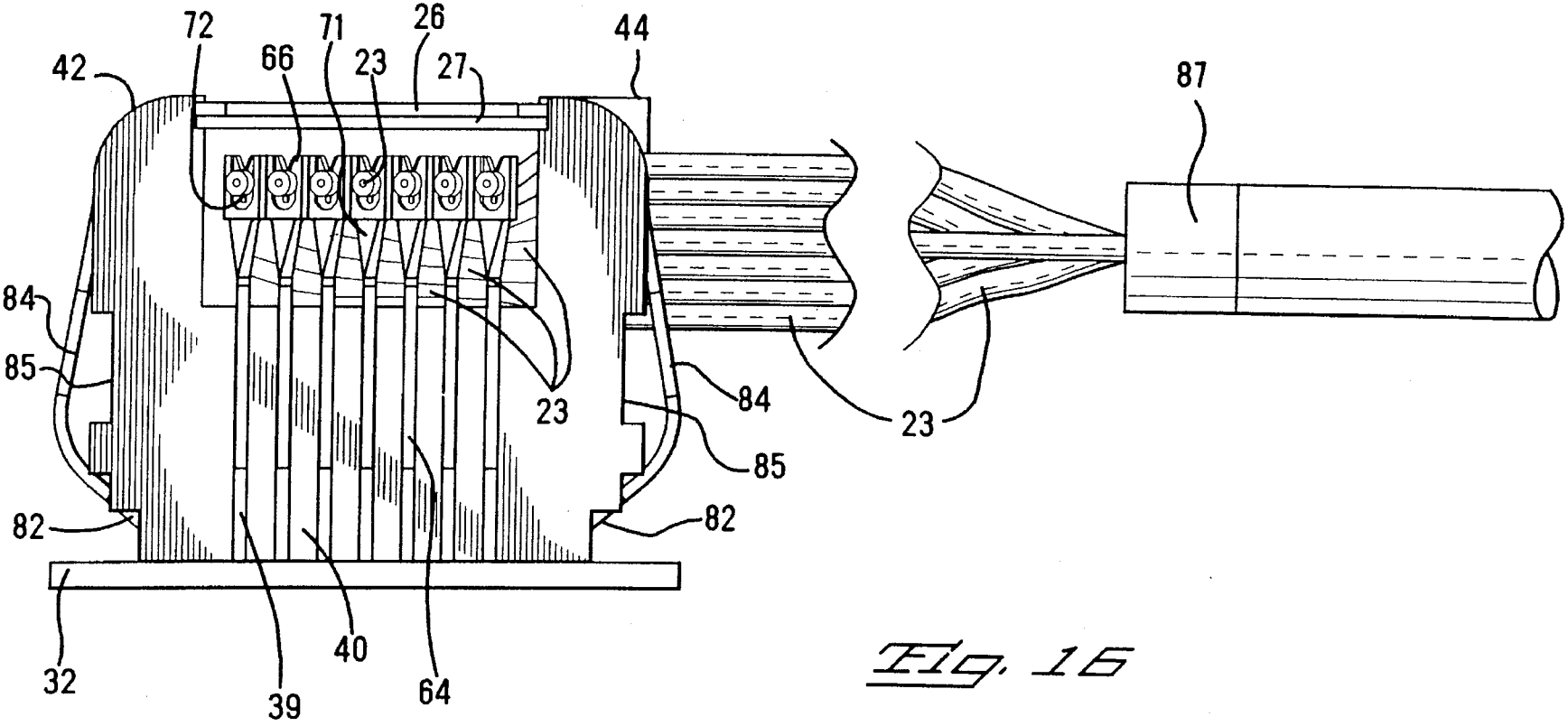
FIG. 16 is a longitudinal-sectional view of the adapter assembly completely assembled (the clip is locked, the wires terminate in the contacts).

The lower portion 61 of each contact 22 is received in the respective slot 39 on the main body portion 33. As shown in FIG. 12, the slot 39 includes a supporting wall 73, which extends within the slot 39 between two adjacent separating walls 40, and provides a supporting ledge 74 for supporting the beam 67 of the contact 22. The retention fingers 63, 64 resiliently engage a front and rear walls 75, 76 of the supporting wall 73. The front wall 75 provides a recess 77 to receive the barbed end 70 of the retention finger 64, thereby locking the contact 22 in the respective slot 39. The contact leg 65 resiliently engages the contact area 78 on the respective lead 24 by its contact points 69. Thereby a reliable electrical contact between the electrical conductor 23 and the respective lead 24 is accomplished. Once contacts 22 are installed in the respective slots 39, the electrical conductors 23 are terminated in the respective bifurcated ends 66 of the respective contacts 22, and the adapter housing 21 is pushed on the IC package 25, then the clip 26 can be locked in (after the spacer 27 has been removed).

As per FIGS. 3, 4, 7–11, 14–16, the metallic clip 26 includes a main portion 79 and two side portions 80 integrally connected by the main portion 79. Each side portion 80 has two inturned fingers 81 connected integrally on one end, and providing respective tips 82. Each tip 82 being received into respective recesses 85 on the bottom of the adapter housing 21, contacts the IC body 28 in respective end contact area 83. Each inturned finger 81 also has a respective tab 84. The main portion 79 and the side portions 80 are supported by the arched upper edges 41 of the walls 34, 35 between the respective corner members. The main portion 79 protects upper portions 62 of the contacts 22 from mechanical occasional interference. The side portions 80 of the clip 26 embrace the external surfaces of the walls 34, 35, such that the tabs 84 are pressed into the recesses 48, 49 thereby placing the clip 26 in locked position.

Each side portion 80 of the clip 26 provides a respective clip slot 86 between the respective inturned fingers 81. The clip slot 86 is formed in precise registration with the slots 47 on the wall 35 to allow the electrical conductors 23 to protrude through both the slots 47 and the clip slot 86. The electrical conductors 23 exit from the adapter assembly 20 to be connected to a remote receptacle connector 87 shown in FIG. 16.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An adapter assembly for electrical connection with an integrated circuit (IC), the IC including an IC body having a pair of sides, at least one of the sides of the IC body having respective spaced-apart leads, said adapter assembly comprising:

an adapter housing including a main body portion, and further including first and second spaced-apart walls integrally connected by the main body portion, the spaced apart walls being raised above the main body portion of the adapter housing, the main body portion including a plurality of spaced-apart slots substantially parallel with the respective first and second walls of the adapter housing, and a plurality of contacts, each contact having a respective lower portion and a respective upper portion, said lower portions of the contacts being received in the slots of the main body portion of the adapter housing, each contact being electrically connected by its respective lower portion to a respective lead on the IC body, the upper portions of the contacts being accommodated between the respective first and second walls above the main body portion of the adapter housing, the first wall of the adapter housing including at least one opening for receiving respective electrical conductors, each electrical conductor being in electrical connection with the upper portion of the respective contact, wherein said adapter housing further includes a cavity for receiving the IC body, the IC body having a plurality of spaced-apart side retention areas and first and second end retention areas, respectively, and wherein said adapter housing further includes a first and a second retention means disposed within said cavity, said first retention means being in a frictional interference with the respective side retention areas of the IC body, and said second retention means being in a frictional interference with the respective end retention areas of the IC body, thereby retaining the IC within the adapter housing in predetermined interposition, wherein the side retention areas of the IC body are located between two adjacent leads, wherein the cavity is located in the bottom part of the adapter housing and includes a first and a second spaced-apart sidewalls, wherein the first retention means includes a plurality of spaced-apart retention teeth located on the first and the second respective sidewalls of the cavity, and wherein each retention tooth engages the respective side retention area on the IC body,

2. The adapter assembly according to claim 1, wherein the first and second end retention areas are located on first and second ends of the IC body, respectively, wherein the cavity includes first and second ends, and wherein the second retention means includes first and second retention members located on the first and second ends of the cavity, respectively, and wherein the first and second retention members engage the respective end retention areas on the IC body.

3. The adapter assembly according to claim 1, wherein the lower portion of each contact includes first and second retention fingers, and a contact leg, wherein the respective upper portion, the first and the second retention fingers and the contact leg of each contact are integrally joined, and wherein the upper portion of the contact includes a bifurcated end, the bifurcated end providing an insulation displacement contact area for the respective electrical conductor termination, wherein the contact leg provides a contact point for engagement with the respective lead, and wherein the first retention finger provides a barbed end, the barbed end retaining the contact within the respective slot on the main body portion.

4. The adapter assembly according to claim 3, wherein the first and second walls of the adapter housing each provides respective retention recessess, said adapter assembly further includes a removable clip, the clip having a main portion and first and second side portions integrally connected by the main portion, wherein each of the side porting includes first and second spaced-apart inturned fingers, wherein each of the first and second inturned finger provides a respective tip, and wherein each of the first and second inturned fingers further provides a tab, wherein the main portion of the clip being supported by the first and second walls of the adapter housing covers the upper portions of the contacts, wherein the first and second side portions of the clip embrace outwardly the first and second walls of the adapter housing, respectively, wherein the respective tips engage the respective areas on the IC body adjacent to the respective end retention area on the IC body, and wherein the respective tabs are pressed into the respective recesses on the respective first and second walls of the adapter housing, thereby locking the clip over the adapter housing in the lock position.

5. The adapter assembly of claim 4, wherein each contact includes a twisted neck integrally joining the upper portion and the lower portion of the contact, respectively, wherein said twisted neck provides a predetermined angle between the upper portion and the lower portion of the contact, respectively, thereby turning the bifurcated end towards the respective electrical conductor.

6. The adapter assembly of claim 4, wherein each side portion of the clip includes a respective clip slot between the respective first and second spaced-apart inturned fingers, wherein the clip slot is in registration with the respective openings on the first wall of the adapter housing, and wherein said electrical conductors extend through the respective openings in the first wall of the adapter housing and through a corresponding clip slot on the respective side portion of the clip.

7. The adapter assembly of claim 6, further including a spacer, said spacer being removably inserted between the main portion of the clip and the upper portions of the contacts.

8. An adapter assembly for electrical connection with an integrated circuit (IC), the IC including an IC body having a pair of opposite sides, at least one of the sides of the IC body having respective spaced-apart leads, said adapter assembly comprising:

an adapter housing including a main body portion having a plurality slots and a plurality of contacts disposed in respective ones of the slots, the contacts having respective upper portions adapted for electrical connection with respective electrical conductors, and respective lower portions adapted for electrical connection with respective leads on the IC body, the adaptor housing having a cavity which is open to a bottom of the housing for receiving the IC body therein, the cavity including first and second laterally spaced apart sidewalls, the adaptor housing having a first retention means including a plurality of retention teeth on the first and second sidewalls, the retention teeth on at least one of the sidewalls being spaced apart and arranged for interposition between adjacent pairs of the leads when the IC body is disposed in the cavity, the plurality of retention teeth extending into the cavity and arranged to engage the opposite sides of the IC body with a friction fit.

9. The adapter assembly according to claim 8, wherein the adaptor housing has a second retention means including first and second retention members disposed at respective first and second ends of the cavity, the first and second retention members being arranged to engage opposite ends of the IC body with a friction fit.

10. The adapter assembly according to claim 8, wherein the lower portion of each contact includes first and second retention fingers, and a contact leg, wherein the respective upper portion, the first and the second retention fingers and the contact leg of each contact are integrally joined, and wherein the upper portion of the contact includes a bifurcated end, the bifurcated end providing an insulation displacement contact area for the respective electrical conductor termination, wherein the contact leg provides a contact point for engagement with the respective lead, and wherein the first retention finger provides a barbed end, the barbed end retaining the contact within the respective slot in the main body portion.

11. The adapter assembly according to claim 10, wherein each contact includes a twisted neck integrally joining the upper and lower portions thereof, wherein said twisted neck disposes the upper portion at an angle with respect to the lower portion, such that the bifurcated end is aligned for receiving a said respective electrical conductor.

12. The adapter assembly according to claim 8, wherein the adaptor housing has first and second spaced-apart walls extending above the main body portion at respective opposite ends thereof, and further comprising a removable clip disposed on the adaptor housing, the clip having a main portion which spans a space between the walls so as to cover the upper portions of the contacts, and the clip having side portions which extend downwardly from the main portion, each of the side portions having first and second spaced-apart inturned fingers which extend into the cavity through respective recesses in the adaptor housing, wherein the inturned fingers of each of the side portions engage respective opposite ends of the IC body.

13. The adapter assembly according to claim 12, wherein one of the side portions of the clip includes a respective clip slot between its said first and second spaced-apart inturned fingers, and wherein the clip slot is in registration with an opening in the first wall of the adapter housing, such that the electrical conductors may extend through the clip slot and through the opening in the first wall of the adapter housing.

14. The adapter assembly according to claim 12, further including a spacer removably disposed between the main portion of the clip and the upper portions of the contacts.

* * * * *